United States Patent [19]

Burcham

[11] 4,094,114

[45] June 13, 1978

[54] DETACHABLE WALL MOUNTING SYSTEM

[76] Inventor: Gerald C. Burcham, P.O. Box 285, Mountain View, Calif. 94040

[21] Appl. No.: 717,826

[22] Filed: Aug. 26, 1976

[51] Int. Cl.[2] ..... E04B 5/52

[52] U.S. Cl. ..... 52/489

[58] Field of Search ..... 52/481, 489, 238, 241; 24/259 R

[56] References Cited

U.S. PATENT DOCUMENTS

| | | | |
|---|---|---|---|
| 3,753,325 | 8/1973 | Stanley | 52/481 |
| 3,759,001 | 9/1973 | Judkins | 52/489 |
| 3,922,764 | 12/1975 | Downing | 24/259 R |
| 3,986,313 | 10/1976 | Nelsson | 52/241 |
| 3,998,018 | 12/1976 | Hodges | 52/489 |

FOREIGN PATENT DOCUMENTS

| | | | |
|---|---|---|---|
| 658,374 | 10/1951 | United Kingdom | 52/489 |

*Primary Examiner*—John E. Murtagh

*Attorney, Agent, or Firm*—Townsend and Townsend

[57] ABSTRACT

A support structure for non-progressive modular wall systems includes a panel retaining clip and channel-shaped stud formed for positive interlocking engagement. The clip is made of spring steel and is formed with several fingers which are adapted to be pressed over a flange portion of the stud. The fingers which contact the interior surface of the stud flange are formed with one or more forwardly extending projections. These projections form barbs which are securely captured behind a bead on the stud flange when the clips and attached wallboard are pressed into place.

2 Claims, 4 Drawing Figures

DETACHABLE WALL MOUNTING SYSTEM

BACKGROUND OF THE INVENTION

The present invention relates to building wall systems and is more specifically directed to a wall system of the nonprogressive type featuring a clip and channel arrangement which provides a direct and positive locking attachment of the wallboard panels to the supporting studs.

Various types of wallboard retaining clips and metal channel studs are utilized in building construction to erect so called "modular" wall systems which can be quickly assembled and disassembled without the use of screws, bolts, nails or the like. It is desirable in the design of such systems to be able to easily remove individual wallboard panels from an assembled wall system for repair or replacement. Also, it is frequently desirable to reposition an entire wall. Typical prior art systems which have been developed for this purpose are shown in U.S. Pat. No. 3,922,764 issued to Downing and U.S. Pat. No. 3,732,660 issued to Byssing.

Prior art wall mounting systems of the type described above typically utilize a number of metal retaining clips which are pressed into the opposite edges of the wallboard panel and snap over the flange portion of a vertically extending channel shaped metal stud. This frictional engagement subjects the wall system to undesirable vibration under dynamic loading. Also, the design of the various types of clips and studs which are available typically require that a panel be mounted between a pair of studs by simultaneous attachment of the clips on both ends of the wallboard to the corresponding stud flanges. Such designs require a rigid horizontal support member extending between the studs to maintain their relative position until the wallboard is attached. This presents problems in terms of the phenomenon of "growing" where, because of manufacturing tolerances in the size of the wallboard, the width of a particular panel may be slightly less than or slightly more than the distance between adjacent mounting flanges as determined by the horizontal support member.

SUMMARY OF THE INVENTION

The present invention comprises a support structure for a non-progressive wall system made up of a series of individually detachable side-by-side panels which are attached to metal studs by means of metal retaining clips inserted into the edges of the panels. The panel retaining clips and support studs are designed for interlocking engagement which provides a direct and positive attachment of the wall panel to the stud instead of a friction of snap fit attachment as in prior art systems. Thus, the present invention combines the ease of assembly and disassembly of the non-progressive wall systems described above with a rigidity typical of attachment by nails or screws.

Direct interlocking attachment is provided by the coaction of one or more barbs or tangs on the panel retaining clip with a vertical bead running along the length of the stud on the interior surface of each mounting flange. When the wall is mounted to the stud by pressing the clip over the flange, the barb is captured in locking engagement behind the bead. This positive locking attachment allows a wall panel to be erected by attachment along one side to a single support stud. The adjacent stud is thus allowed to "float" until the clip and drywall are attached. Thus, the system allows for wall erection without the use of horizontal supports and allows compensation for the phenomenon of drywall growing referred to above.

After wall assembly, if it is desired to remove a particular wallboard panel, the baseboard molding is removed and the panel is pulled forward and away from the plane of the wall. This causes the wallboard to be torn free of the retaining clips through the rear half of the wallboard thickness and the exterior surface of the wallboard is not marred. The retaining clips are then pried from the stud flanges with a suitable tool such as a screwdriver. The clips are made of a resilient material such as spring steel and will return to their original shape after removal.

When an individual panel is to be replaced, a suitable number of clips are inserted into the side edges of the wallboard (at locations where it has not been torn) and the wallboard is pressed directly into place forcing the clips onto the stud flanges and capturing the tang on the clips behind the bead on the flange. Thus, individual wallboard panels can be easily removed for repair of replacement and entire walls may be repositioned without visible damage to the exterior wall surface. CL

DETAILED DESCRIPTION OF THE PREFERRED EMBODIMENT

Figure 1A:
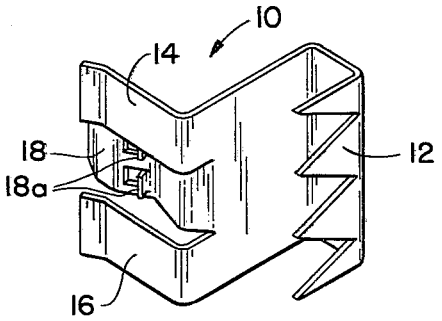
FIGS. 1A and 1B are perspective views of the front and back respectively of one type of wallboard retaining clip according to the present invention.
Figure 1B:
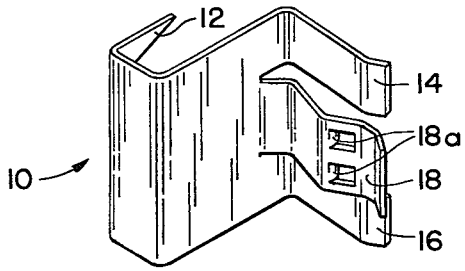
Figure 2:
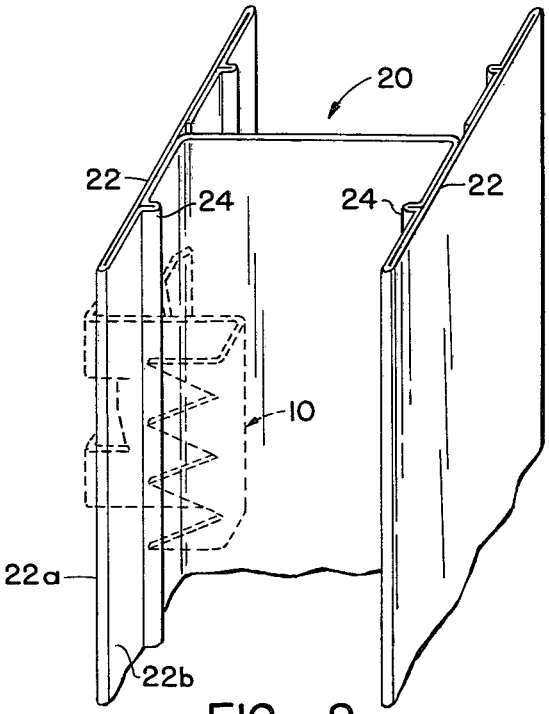
FIG. 2 is a perspective view of a portion of a vertically extending H-channel stud depicting an attached retaining clip in phantom view.
Figure 3:
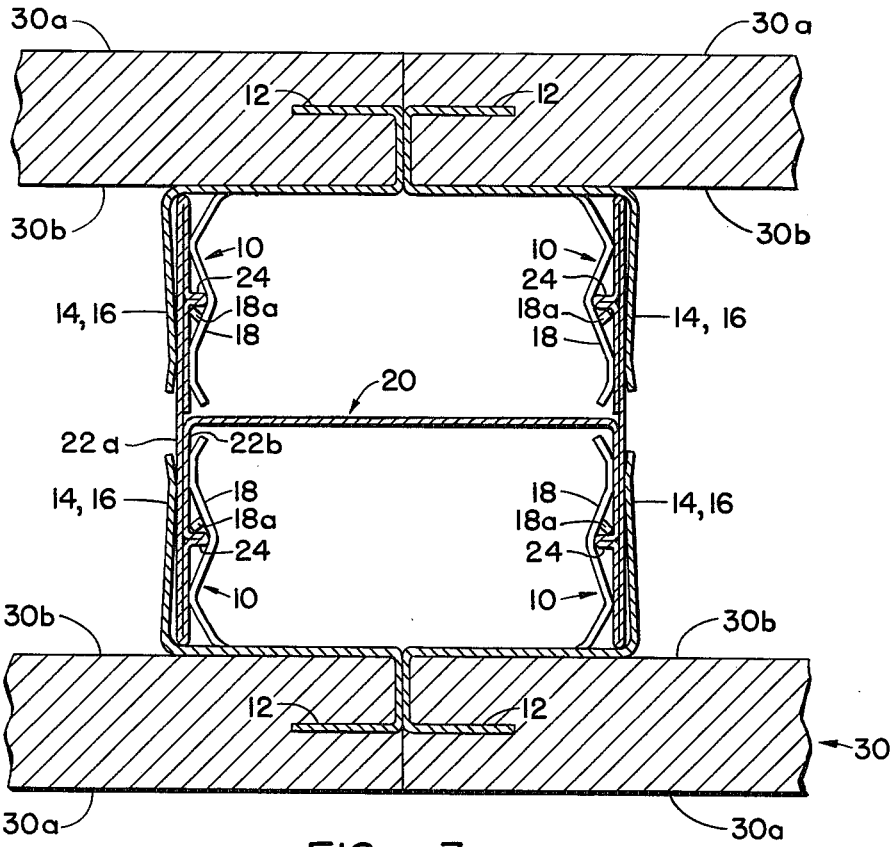
FIG. 3 is a cross-section elevation view of a portion of an assembled wall system illustrating the interlocking engagement between the retaining clips and support studs of the present invention as well as the final positioning of the wallboard panels.

Referring now to the Figures, the wallboard retaining clip of the present invention is generally designated at 10, the H-section metal supporting stud at 20, and the wallboard panels themselves at 30.

The clips are provided at one end with a series of serrations or teeth 12 which are pressed into the side edge of a wallboard panel approximately midway between the exterior and interior faces of the wallboard panel, **30*a* and 30*b* respectively. The other end of the retaining clip is formed with three fingers, including outer fingers 14 and 16 and central finger 18. When the wall system is assembled, these fingers pass over the flange portion 22 of stud 20 with outer fingers 14 and 16 contacting the outer surface 22*a* of the stud flange and central finger 18 contacting the inner surface 22*b*** of the stud flange.

The central finger 18 of the clip is formed with two forwardly (i.e. toward the wall) extending projections or barbs **18*a*. When the clip fingers are pressed over the stud flange these barbs are captured behind bead 24 which extends vertically along the interior surface 22*b* of the stud flange. The clip is preferably made of resilient material such as spring steel and thus there is enough flexibility in the clip fingers 14, 16 and 18 so that the fingers may be easily pressed over the stud flange and bead. However, once barbs 18*a* are captured behind bead 24** the clip and the attached wallboard are firmly and securely positioned.

The clip of the present invention allows use of a floating stud approach to wall construction wherein the clips along one edge of a wallboard panel are pressed onto the corresponding stud flange while the stud adjacent the opposite end of the panel is free to be moved into precise alignment with the clips on the confronting edge of the panel. This eliminates the need for horizontal stud supporting members as well as dimensional problems associated with the phenomenon of drywall growing described above.

When it is necessary to remove an individual panel such as for repair, replacement, or access to the interwall space, the wall baseboard is removed and the panel is grasped and pulled forward and away from the plane of the wall. The clips remain on the studs and are torn from the panels through the rear half of the panel thickness. This allows the panel to be removed without marring the exterior surface. After the panel has been removed, the individual clips can be detached from the stud flange by prying them off with a suitable tool, such as a screwdriver. Since the clips are resilient, they will return to their original shape and can be used for reinstallation of the panel.

When a panel is to be replaced, retaining clips are inserted into opposite side edges of the panel at locations which have not previously received clips and the panel is simply pressed back into place forcing the clips over stud flanges and again capturing the clip barbs behind the beads on the interior flange surfaces.

While a preferred embodiment of the present invention has been shown and described above, it will be apparent that various modifications of the structure disclosed can be made without departing from the spirit and scope of the invention as defined by the appended claims. For example, the stud members may be shaped with an inverted "U" cross-section or various other shapes as long as a spaced pair of flange surfaces are presented at right angles to the plane of the assembled wall panels. Also, other types and forms of positive interlock mechanisms which differ only slightly from the depicted barb and bead arrangement are contemplated as within the scope of the invention.

What is claimed is:

1. A system for supporting a plurality of side-by-side individually detachable wall panels in a wall plane comprising:

(a) a plurality of vertically disposed support studs each having at least one flange portion oriented perpendicular to said wall plane;

(b) a bead formed on a surface of said flange portion and extending vertically along said flange surface substantially the entire length thereof;

(c) a plurality of panel retaining clips each having a panel attachment portion formed for piercing an edge of one of said wall panels and a stud attachment portion formed for slideable insertion onto said stud flange; and (d) a barb formed on said stud attachment portion of each of said clips, said barb being oriented toward said wall plane for positive interlocking engagement behind said bead when said clip is slideably inserted onto said flange, whereby forces exerted on said clip in a direction transverse to said wall plane and away from said stud act to further reinforce said positive interlocking engagement.

2. The wall support system of claim 1 wherein said stud attachment portion of said clip further comprises a plurality of finger elements for receiving said flange therebetween and wherein said barb is formed on at least one of said fingers contacting said flange surface on which said bead is formed.

* * * * *